United States Patent [19]

Yamamoto et al.

[11] Patent Number: 4,589,364

[45] Date of Patent: May 20, 1986

[54] SEWING MACHINE TOP FEED

[75] Inventors: Khoichi Yamamoto; Takashi Kasuda, both of Osaka, Japan

[73] Assignee: Pegasus Sewing Machine Mfg. Co. Ltd., Osaka, Japan

[21] Appl. No.: 557,764

[22] Filed: Dec. 2, 1983

[30] Foreign Application Priority Data

Dec. 9, 1982 [JP] Japan ..... 57-216400
Dec. 21, 1982 [JP] Japan ..... 57-225294

[51] Int. Cl.[4] ..... D05B 27/06
[52] U.S. Cl. ..... 112/311; 112/313
[58] Field of Search ..... 112/311, 312, 313, 314, 112/122, 320

[56] References Cited

U.S. PATENT DOCUMENTS 3,530,809 9/1970 Porter .
3,636,899 1/1972 Crisler .
3,995,571 12/1976 Porter .
4,166,422 9/1979 Porter .
4,285,294 8/1981 Aida .
4,295,434 10/1981 Hsiao ..... 112/314
4,417,536 11/1983 Shiomi ..... 112/311
4,421,047 12/1983 Alberti ..... 112/311

FOREIGN PATENT DOCUMENTS 57-26795 6/1982 Japan .

*Primary Examiner*—Werner H. Schroeder
*Assistant Examiner*—Andrew M. Falik
*Attorney, Agent, or Firm*—Flynn, Thiel, Boutell & Tanis

[57] ABSTRACT

A top feed device for a sewing machine has an upper feed dog movable horizontally and vertically in synchronism with operation of a lower feed dog. The upper feed dog is vertically moved by a spring for depressing an upper feed arm to which the upper feed dog is attached, and a crank engages the upper feed arm and is vertically swingable, the crank being held in engagement with the upper feed arm at all times to prevent striking engagement therewith. A swingable shaft to which the crank is fixed and a lever angularly movably mounted on the swingable shaft and swingable in coaction with a drive shaft have abutments projecting axially in confronting relation. The abutments on the shaft are urged by a spring to angularly move in one direction. The abutments on the lever which are held against the other abutments are disengaged therefrom in a circumferential direction when the upper feed dog reaches a throat plate and stops its downward movement. Then, the abutments on the lever are reversed and brought into engagement with the abutments on the shaft. A substantial portion of the swingable shaft and the lever are accommodated in a closed sewing machine body.

17 Claims, 12 Drawing Figures

SEWING MACHINE TOP FEED

BACKGROUND OF THE INVENTION

The present invention relates to a top feed device for a sewing machine having an upper feed dog actuatable in synchronism with a lower feed dog for composite movement composed of horizontal motion and vertical motion.

Prior top feed devices for sewing machines have an upper feed dog disposed on a free end of an upper feed arm journalled for vertical angular movement on a drive member which is operatively connected to a lower feed dog and reciprocally movable in a horizontal direction. The upper feed dog can vertically be moved by a spring for depressing the upper feed arm and a crank swingable vertically in coaction with a main shaft. More specifically, the upper feed arm is raised against the action of the spring when the crank is angularly moved upwardly, and is lowered with the crank under the force of the spring when the crank is angularly moved downwardly. After the upper feed dog movable up and down with the swinging movement of the crank has been lowered to reach a fabric on the throat plate, the upper feed dog will not be lowered anymore and will not follow the downward swinging movement of the crank, but instead will feed the fabric while being pressed thereagainst under the bias of the spring. During the fabric feeding movement, the crank continues to swing down to a lower limit and then up toward an upper limit. On the upward swinging movement, the crank engages and lifts the upper feed arm, thus raising the upper feed dog clear of engagement with the fabric. When the crank hits the upper feed arm, there is produced an impact sound, which sound increases in volume as the speed of operation of the sewing machine increases.

There has been proposed an attempt for dampening such an impact by providing a damper between the upper feed arm and the crank.

SUMMARY OF THE INVENTION

It is an object of the present invention to provide a top feed device which eliminates the foregoing difficulty. One solution according to the present invention is to confine a source of impact sounds against leakage in a fully closed container. It would not be preferable to close the position where an upper feed arm and a crank hit each other simply with a cover or container, since it would be necessary to provide a vertical gap to allow the upper feed arm to project out from the cover or container or to permit an upper feed dog to move vertically, thus failing to provide a fully closed construction.

Another object of the present invention is to provide a top feed device in which a source of impact sounds is positioned separately and accommodated in a closed container. The closed container preferably comprises a body of a high-speed sewing machine with forced or splash lubrication. In such a sewing machine, the sewing machine body is of a closed construction having a metal cover of considerable thickness and packings for preventing oil leakage due to oil splashing and noise caused by high-speed operation. Utilization of such a closed construction necessitates no newly added closed container.

Another solution according to the present invention is to reduce the relative speed of parts at the time they hit each other, thereby reducing any resulting impact force. One way to reduce such speed is to shorten the crank for thereby reducing the peripheral speed thereof. It would not be preferable, however, to shorten the crank only since by doing so a desired vertical interval of movement of the upper feed dog would not be available. This problem can be solved by positioning the crank close to the center of swinging movement of the upper feed arm, with the result that the upper feed arm can move a desired vertical interval even with the crank having a shortened dimension.

Still another object of the present invention is therefore to provide a top feed device having a shortened crank positioned close to the center of swinging movement of the upper feed arm.

Another way to reduce the speed of hitting engagement of the parts is to make the parts hit each other in the vicinity of a stroke limit where the speed of movement is zero.

Accordingly, still another object of the present invention is to provide a top feed device in which parts hit each other at a position where the speed of the parts is small in the vicinity of a stroke limit.

According to an embodiment of the present invention, a crank and a swingable shaft on which the crank is angularly movably mounted have engagement portions which are circumferentially disengageable from each other and normally held in engagement under the resiliency of a spring biasing the upper feed arm to move downwardly, thereby causing the crank and the swingable arm to move in unison.

According to another most preferable embodiment of the present invention, a swingable shaft to which a crank is fixed is coupled in a close sewing machine body to a main shaft, a cutter shaft for vertically moving an upper cutter for cutting a fabric, or other existing drive shaft through a transmission device have engagement portions held in engagement with each other as in the foregoing embodiment. With this engagement, any impact sound is reduced and confined against leakage, thus achieving the above two objects.

Still another way to reduce the speed at the time the parts hit each other is to reduce the angular interval of movement of the crank.

By positioning the crank close to the center of swinging movement of the upper feed arm without changing the length of the crank, the angular interval of movement of the crank for turning the upper feed arm for a certain interval is reduced.

A still further object of the present invention is to provide a top feed device in which a crank is positioned close to the center of swinging movement of an upper feed arm to reduce an angular interval of movement of the crank.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
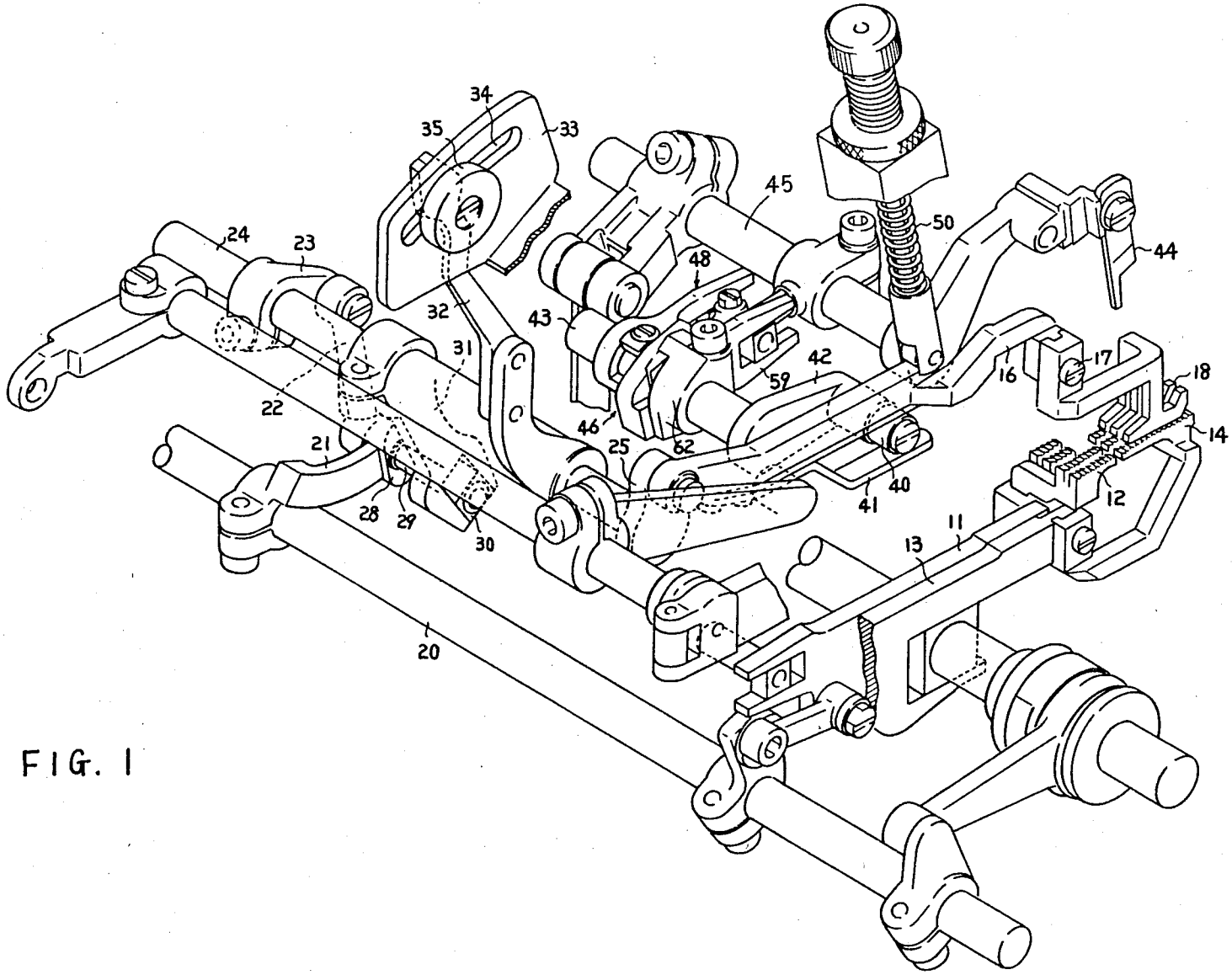
FIG. 1 is a perspective view of a feeding apparatus in a sewing machine.

As shown in FIG. 1, a feeding apparatus for a sewing machine comprises a known bottom feed device composed of a main feed dog 12 supported on a main feed bar 12 and a differential feed dog 14 supported on a differential feed bar 13. The feeding apparatus also includes a top feed device having an upper feed dog 18 secured by a screw 17 to one end of an upper feed arm 16 and disposed over either the main feed dog 12 or the differential feed dog 14. The upper feed dog 18 is actuatable in synchronism with the lower feed dog for composite movement composed of horizontal motion and vertical motion and coacts with the lower feed dogs for feeding a fabric. The top feed device further includes a first mechanism (FIG. 2) for horizontally moving the upper feed dog 18 and a second mechanism (FIG. 3) for vertically moving the upper feed dog 18.

Figure 2:
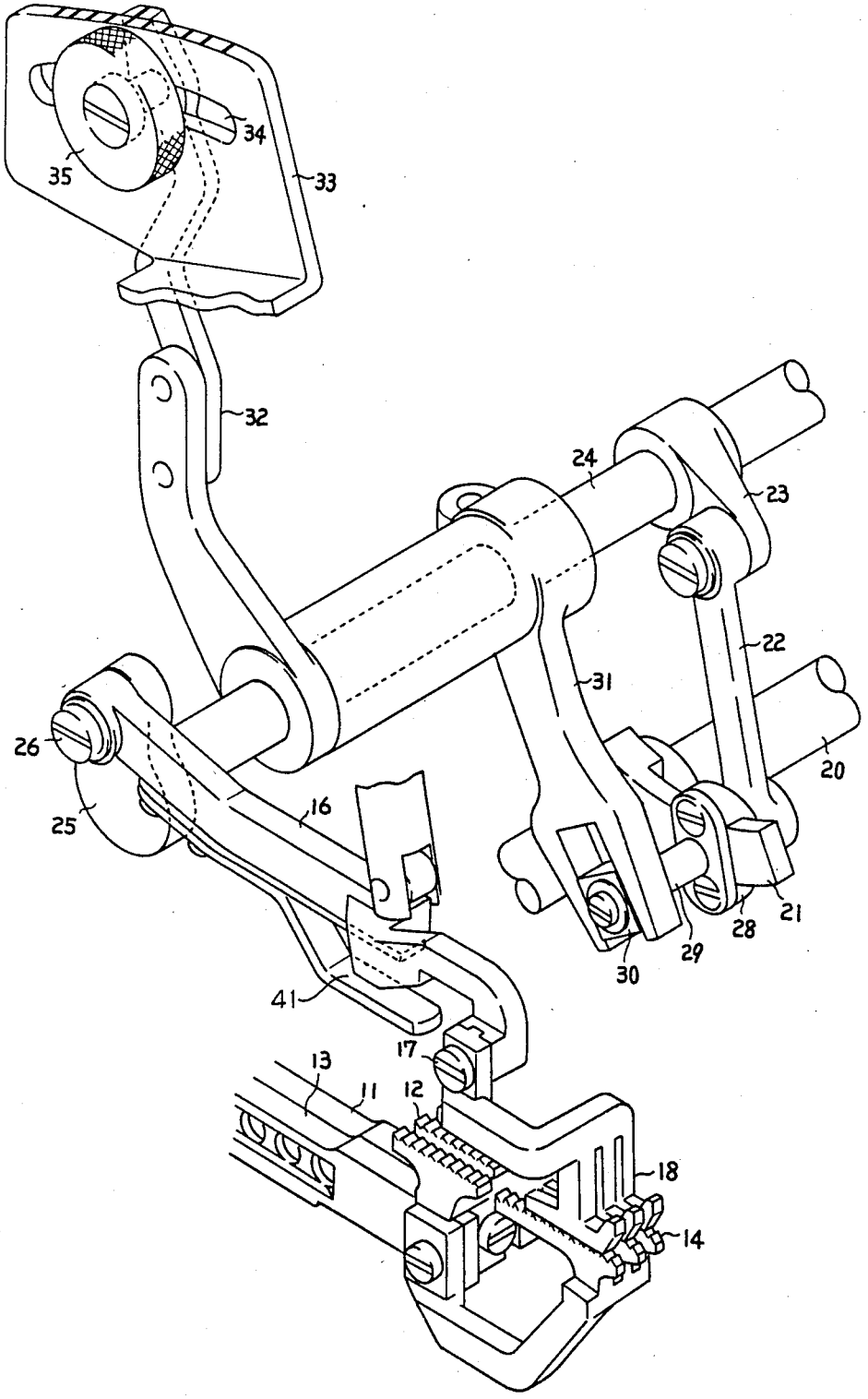
FIG. 2 is a perspective view of a mechanism in the feeding apparatus of FIG. 1 for horizontally moving an upper feed dog.

As shown in FIGS. 1 and 2, the first mechanism for horizontally moving the upper feed dog 18 is coupled to a feed shaft 20 for horizontally moving the lower feed dogs through a crank lever mechanism composed of an arcuate crank 21, a link 22, and a lever 23. The first mechanism has an upper feed shaft 24 angularly movable about its own axis in coaction with the feed shaft 20. The upper feed arm 16 is pivotally supported by a crank pin 26 on a crank 25 fixed to an end of the upper feed shaft 25. Therefore, the upper feed dog 18 is horizontally movable in response to swinging movement of the upper feed shaft 24 about its own axis. The interval by which the fabric can be fed by the upper feed dog 18 can be adjusted by sliding a slider 28 along the arcuate crank 21, the slider 28 being fitted over the arcuate crank 21 and attached to the link 22. The slider 28 can be slid along the arcuate crank 21 by a manual adjustment mechanism. The manual adjustment mechanism comprises a bifurcated lever 31 having one end angularly movably mounted on the feed shaft 24 and an opposite bifurcated end fitted over a rectangular block 30 rotatably mounted on a pin 29 projecting from the slider 28, a control lever 32 connected to the bifurcated lever 31, and a knob 35 threaded into the control lever 32 through an arcuate slot 34 defined in a bracket 33 fastened to a sewing machine frame, the arcuate slot 34 extending about the feed shaft 24. The control lever 32 can be pressed against and fixed to the bracket 33 by tightening the knob 35. By loosening the knob 35 and moving along the arcuate slot 34, the control lever 32 can be angularly moved about the feed shaft 24 to cause the bifurcated lever 31 to move the slider 28 along the arcuate crank 21.

Figure 3:
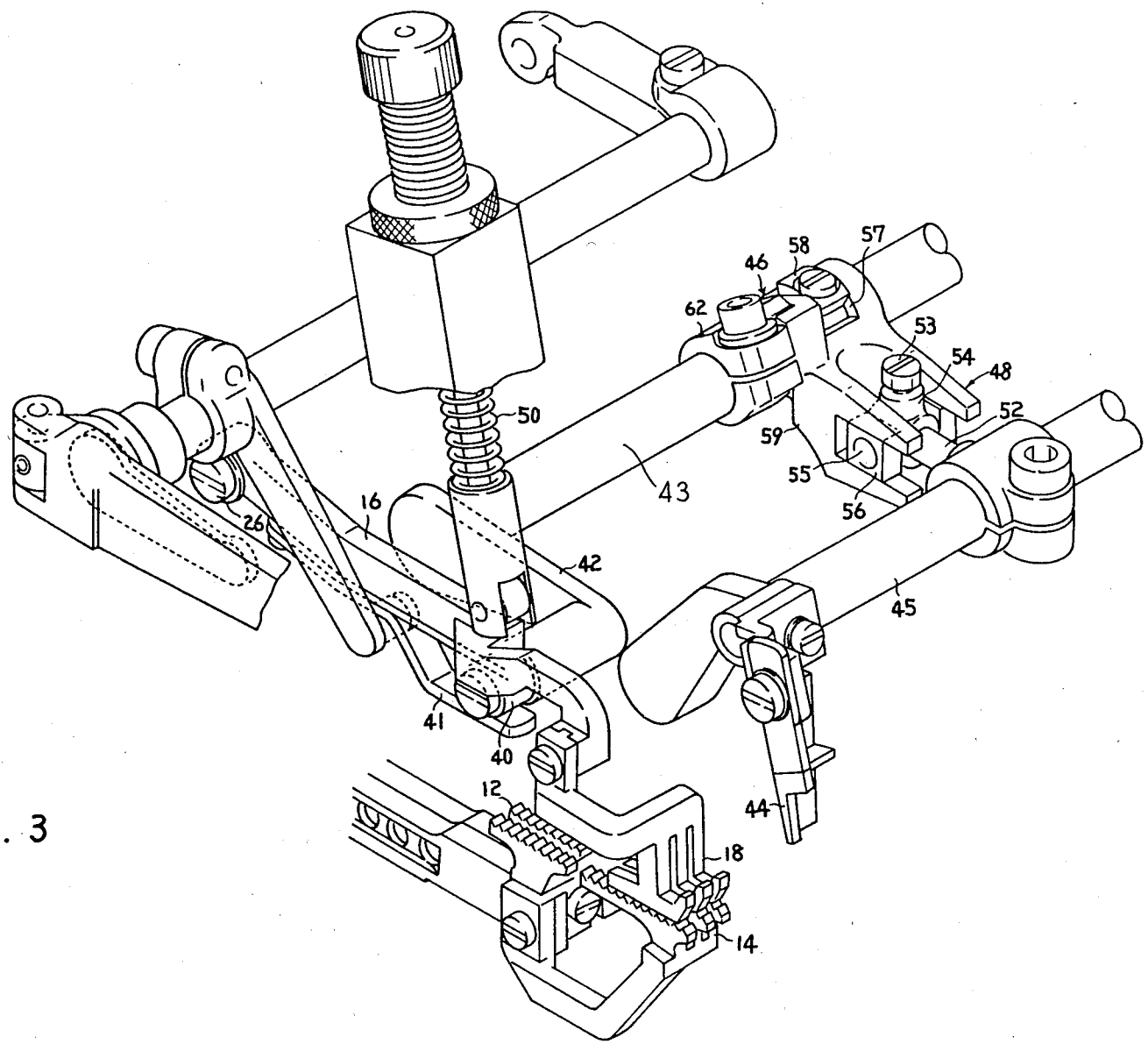
FIG. 3 is a perspective view of a mechanism in the feeding apparatus of FIG. 1 for vertically moving an upper feed dog.

As illustrated in FIGS. 1 and 3, the second mechanism for vertically moving the upper feed dog 18 comprises a swingable shaft 43 having a crank 42 supporting on its end a slider member formed preferably as a roller 40 (as shown) slidably fitted in a guide 41 attached to the upper feed arm 16. A slider crank mechanism 48 connects shaft 43 to a swingable drive or cutter shaft 45 which shaft 45 also drives an upper cutter 44 for cutting the fabric. There is also provided a clutch mechanism 46 as accommodated in a closed sewing machine body for transmitting swinging movement of the drive shaft 45 to the swingable shaft 43. The swinging movement of the crank 42 in coaction with the cutter shaft 45 causes the upper feed arm 16 as pushed downwardly by a spring device 50 to swing vertically about the crank pin 26. The guide 41 may be provided in a bifurcated form as shown, or be in the form of a long slot or a rail for preventing the slide or roller 40 from moving up and down, so that any unwanted impact sound will not be given off which would otherwise be produced by the striking or hitting engagement of the roller 40 with the guide 41 during the swinging movement of the crank 42.

Figure 11:
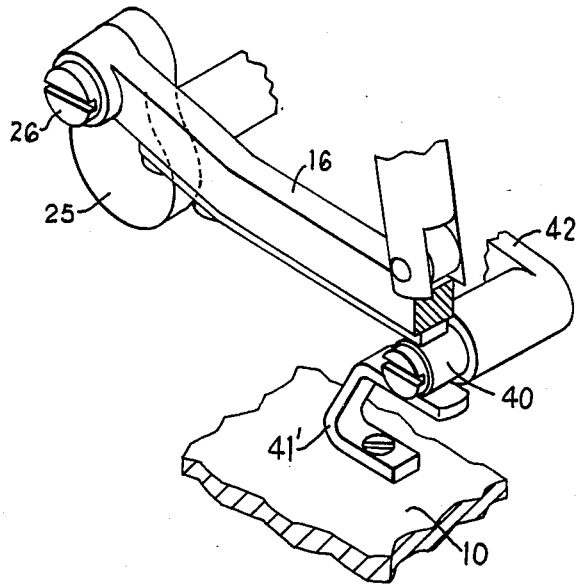
FIG. 11 is a fragmentary view illustrating a modification with respect to the mounting of the guide on the feed arm.
Figure 12:
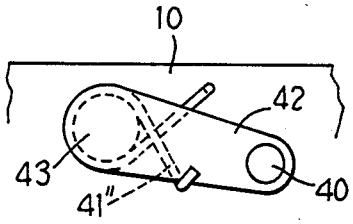
FIG. 12 is a fragmentary view showing a modification employing a spring arrangement for urging a crank upwardly so that the slider is resiliently retained against the upper feed arm.

As a modification of the guide 41 mounted on the upper feed arm 16, a leaf spring guide 41' (FIG. 11) may be fixed to the sewing machine frame 10 for slidably supporting or retaining the slider member 40 from below to prevent the latter from being lowered away from the upper feed arm 16 when the upper feed dog 18 is stopped in its downward movement on reaching the throat plate. As an alternative modification, a helical spring 41 (FIG. 12) weaker than the spring device 50 may be wound on the swingable shaft 43 for urging the crank 42 to move upwardly so that slider member 40 will normally be held or retained resiliently against the upper feeder arm 16.

The slider crank mechanism 48 of the second mechanism comprises a crank 52 in the form of a shaft fixed to the cutter shaft 45, rectangular slide blocks 56 rotatably mounted respectively on pins 55 projecting from opposite sides of a slider 54 which is adjustably positionally fixed to the crank 52 by a setscrew 53, and a bifurcated crank or lever 59 angularly movably mounted on the swingable shaft 43 and retained against axial movement by a guide block 58 secured to the swingable shaft 43 through a circumferential slot 57 defined in the lever 59. The bifurfacted lever 59 has bifurcated arms in which the rectangular slide blocks 56 are slidably fitted, respectively. The angular interval of swinging movement of the bifurcated lever 59, that is, the vertical stroke of the upper feed dog 18, can be adjusted by loosening the setscrew 53 and adjusting the position of the slider 54 with respect to the bifrcated lever 59.

Figure 4:
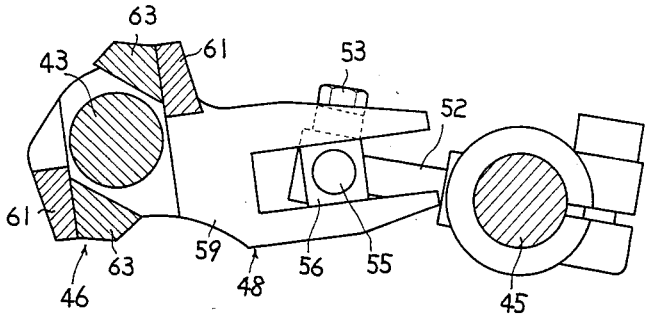
FIG. 4 is a cross-sectional view of a crank lever mechanism with a clutch mechanism in the mechanism shown in FIG. 3, and is illustrative of the position in which a crank is positioned at an upper limit.
Figure 5:
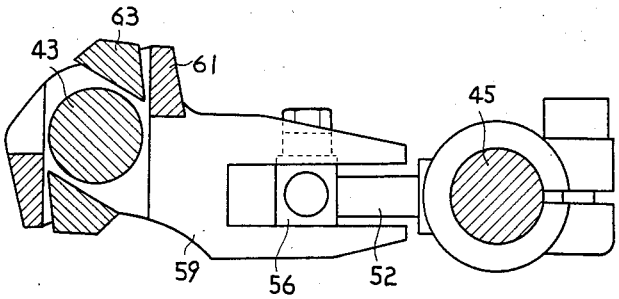
FIG. 5 is a view similar to FIG. 4, showing the position in which the crank is positioned at a lower limit.

As shown in FIGS. 4 and 5, the clutch mechanism 46 includes abutments 61 projecting axially from a boss of the bifurcated lever 59, and abutments 63 projecting from a collar 62 (FIG. 3) fastened to the swingable shaft 43 in confronting relation to the abutments 61, respectively. The abutments 63 are normally urged under the force of the spring device 50 into engagement with the abutments 61, as shown in FIG. 4. Through engagement between the abutments 61, 63, any swinging movement of the cutter shaft 45 can be transmitted to the swingable shaft 43 for vertically moving the upper feed dog 18 (FIG. 4). The abutments 61, 63 should preferably be provided in plurality with circumferential spacings. In the illustrated preferred embodiment, the abutments 61, 63 are diametrically opposite to each other across the center of their angular movement. These abutments 61, 63 hence define a connection which permits limited relative rotative movement between the parts thereof.

When the upper feed dog 18 is stopped in its downward movement on reaching the throat plate or the fabric thereon, the abutments 63 do not follow the movement of the abutments 61 caused by downward angular movement of the crank 52, with the result that the abutments 61 are spaced from the abutments 63 as illustrated in FIG. 5. The abutments 61 are then angularly moved counterclockwise as shown due to upward angular movement of the crank 52 after the latter has reached its lower limit. On the counter-clockwise movement of the abutments 61, they are brought into hitting engagement with the abutments 63. Thereafter, the abutments 61 push the abutments 63 in the same direction against the action of the spring device 50 for thereby raising the upper feed dog 18.

Figure 6:
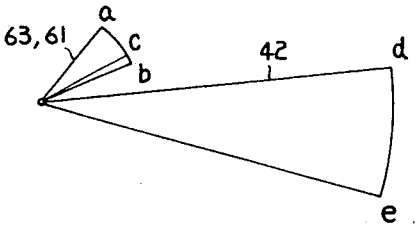
FIG. 6 is a diagram showing the angular intervals of swinging movement of abutments and a crank in the mechanism illustrated in FIG. 3.

FIG. 6 shows the angular intervals of movement of the abutments 61, 63 and the crank 42. While the abutments 61 are angularly moved from a point a to a point b, the crank 42 is angularly moved from an upper limit d to a point e corresponding to the position in which the descent of the crank 42 is stopped, and with such movement of the crank 42 the abutments 63 are turned from the point a to a point c. After the abutments 63 have reached the point c, the abutments 61 continue to turn slightly to the point b away from the abutments 63. After the abutments 61 have reached the point b, they are reversed in motion and then hit the abutments 63 in the point c on their way to the point a. As shown in FIG. 6, the radius of rotation of the abutments 61 is smaller than that of the crank 42, and hence the peripheral speed of the abutments 61 is smaller than that of the crank 42. The abutments 61 hit the abutments 63 with a smaller impact force, producing a smaller impact sound. The point c is closed to the point b where the speed of movement of the abutments 61 is zero. The impact sound is also rendered small since the abutments 61 hit the abutments 63 when the abutments 61 start moving toward the point a at an extremely low speed. The clutch mechanism 46 composed of the abutments 61, 63 is housed in the closed sewing machine body the wall of which has a sound insulation capability for attenuating the impact sound to a much smaller degree.

Figure 7:
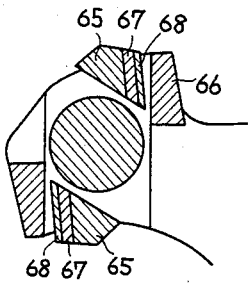
FIG. 7 is a cross-sectional view of a modified clutch mechanism.

It is preferable to provide a damper between the abutments 61, 63 for reducing any impact sound produced and dampening vibrations due to hitting engagement between the abutments 61, 63. FIG. 7 shows one such damper arrangement in which a damper 67 such as of plastic, rubber of other material covered with a metal plate 68 is attached to the surface of each abutment 65 which hits a corresponding abutment 66.

Figure 8:
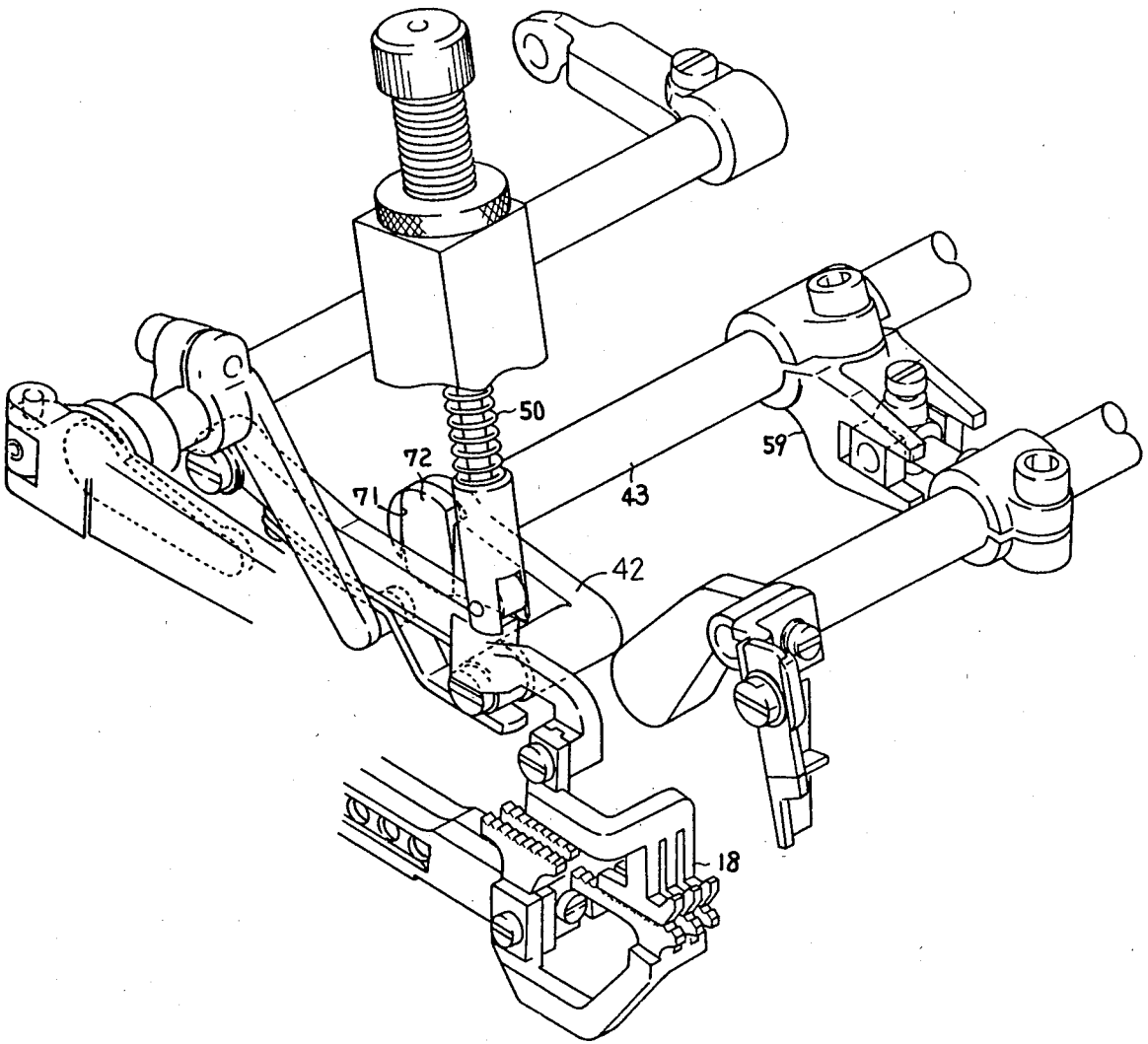
FIG. 8 is a perspective view of a mechanism for moving an upper feed dog according to another embodiment.

FIG. 8 shows a mechanism for vertically moving the upper feed dog according to another embodiment. The bifurcated lever 59 is fixed to the swingable shaft 43, and the crank 42 is angularly movably mounted on the swingable shaft 43 and has a straight groove 71 in its supported end. A block 72 is fixed to the end of the swingable shaft 43 and disposed in the straight groove 71, the block 72 having bevelled diametrically opposite corners so that it can slightly be angularly moved in the groove 71. The crank 42 is swingable with the swingable shaft 43 with the opposite faces of the groove 71 being held against the bevelled corners of the block 72 under the resiliency of the spring device 50. When the swingable shaft 43 is angularly moved clockwise as shown about its own axis to allow the upper feed dog 18 to descend under the force of the spring device 50, the upper feed dog 18 is finally engaged by the throat plate or the fabric placed thereon and is stopped, whereupon the bevelled corners of the block 72 are disengaged from the opposite faces of the groove 71. Coversely, when the swingable shaft 43 is turned counterclockwise, the bevelled corners of the block 72 are caused to hit the opposite faces of the groove 71 during such counterclockwise movement.

The arrangement of FIG. 8 is as advantageous as the construction of the foregoing embodiment. More specifically, the radius of rotation of the block 72 is smaller than that of the crank 42, and hence the peripheral speed of the block 72 is smaller than that of the crank 42. Since the gaps between the opposite faces of the groove 71 and the bevelled corners of the block 72 are extremely small, the speed of movement of the block 72 when it hits the crank 42 is small, resulting in a highly reduced impact sound.

In the FIG. 8 embodiment described above, block 72 and groove 71 are equivalent to the clutch 46 of FIG. 3 in that it also defines a connection which permits limited relative rotative displacement between the parts thereof.

While in the foregoing embodiments the slider crank mechanism has been employed for transmitting swinging movement of the cutter shaft 45 to the swingable shaft 43, other known mechanisms such as a crank lever mechanism can be used in place of the slider crank mechanism. Such a crank lever mechanism may be in the form of the mechanism as shown in FIG. 2 which is capable of adjusting the angular interval of swinging movement of the swingable shaft.

Figure 9:
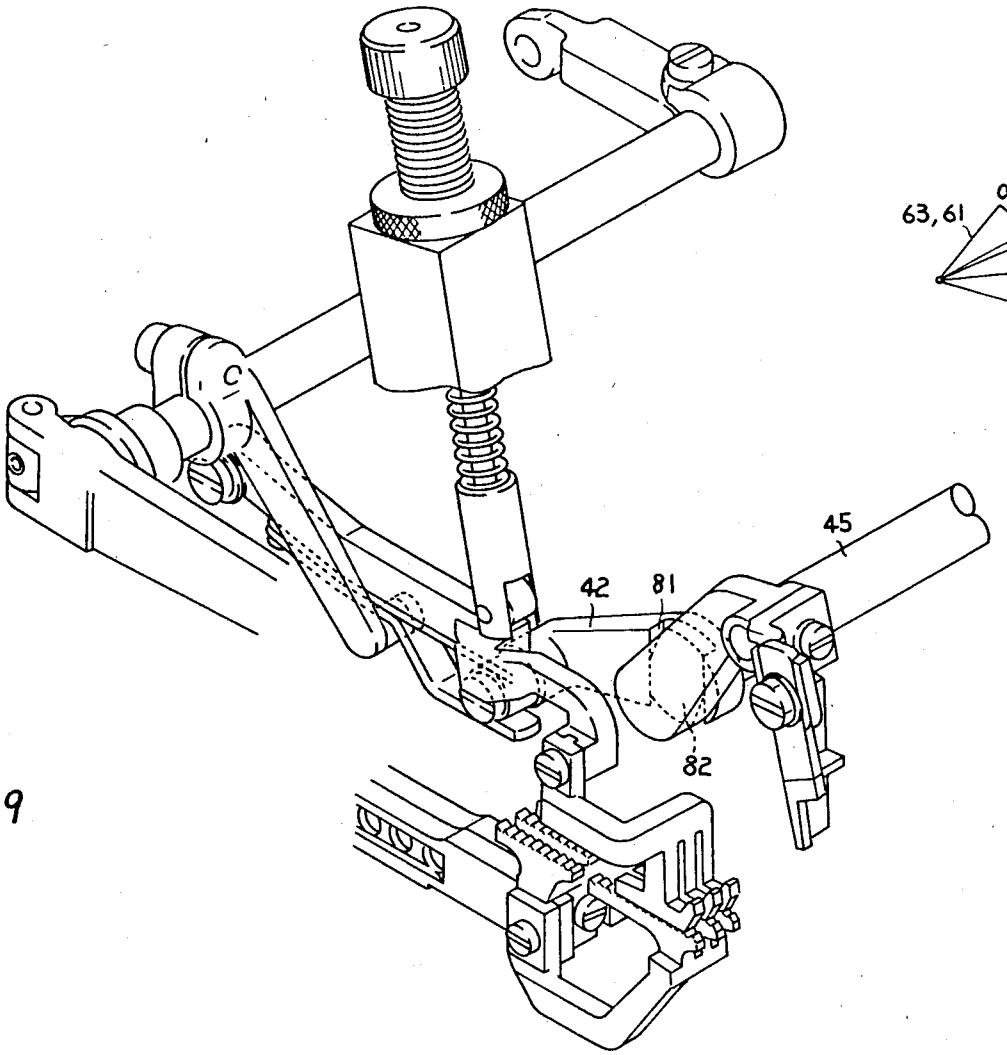
FIG. 9 is a perspective view of a mechanism for moving an upper feed dog according to still another embodiment.

According to still another embodiment illustrated in FIG. 9, the crank 42 is directly mounted on the cutter shaft 45 for angular movement thereon in a similar arrangement to that shown in FIG. 8. More specifically, the crank 42 as angularly movably mounted on the cutter shaft 45 has in its supported end a straight groove 81, and a block 82 of the same construction as that of the block 72 shown in FIG. 8 is secured to the end of the cutter shaft 45, the block 82 being fitted in the straight groove 81 for slight angular movement therein.

With this embodiment, the angular interval of swinging movement of the crank 42, that is, the vertical stroke of the upper feed dog, cannot be adjusted, but the overall construction is simpler as the crank 42 is directly drivable by the cutter shaft 45.

In the second and third embodiments illustrated in FIGS. 8 and 9, one or several abutments project from the shaft of the crank and one or several abutments project from a collar fixed to the swingable shaft for meshing engagement with the first-mentioned abutments, as in the first embodiment.

In the above embodiments, the source of impact sounds is disposed in a position different from that in the prior construction. With the conventional design in which the slider member on the crank hits the upper feed arm, the position of engagement between the slider member and the upper feed arm may be positioned close to the pivot of the upper feed arm for reducing the angular interval of swinging movement of the crank to thereby decrease the angular movement thereof per unit time, or for shortening the crank to thereby reduce the peripheral speed thereof. In addition, the gap between the slider for the crank and the upper feed arm upon reaching a lower limit may be reduced to allow hitting engagement while the speed is small.

Figure 10:
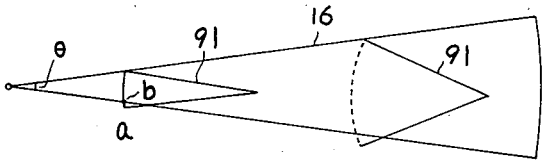
FIG. 10 is a diagram illustrating the angular intervals of swinging movement of an upper feed arm and a crank in the mechanism shown in FIG. 9, showing the fact that the angular interval of the crank as it swings becomes smaller as it is located closer to the center of swinging movement of the upper feed arm.

FIG. 10 is a diagram showing such a condition, in which the path of movement of a slider member on a crank 91 according to the prior art is shown by the dotted line, and that of the present embodiments by the solid line, the crank 91 being of the same length for the dotted and solid lines. FIG. 10 shows that the angular movement of the crank 91 which is required to turn the upper feed arm 16 for a certain interval $\theta$ is smaller in the solid-line arrangement than in the dotted-line arrangement. Accordingly, the peripheral speed of the crank slider member of the invention is smaller than that of the conventional slider member, and the point b in which the slider member hits the upper feed arm is quire close to the lower limit a, thus reducing any impact sound.

While in the illustration the crank is moved toward the pivot of the upper feed arm, the pivot of the upper feed arm may be moved toward the crank. Although only the angular interval of swinging movement is reduced while the length of the crank remains unchanged according to the illustrated arrangement, only the length of the crank may be reduced, or both the angular interval and the length may be reduced.

Although certain preferred embodiments have been shown and described, it should be understood that many changes and modifications may be made therein without departing from the scope of the appended claims.

What is claimed is:

1. A top feed device for coaction with a bottom feed device having a lower feed dog in a sewing machine, said top feed device comprising:

(a) an upper feed arm supported for vertical swinging movement on a drive member adapted to be operatively coupled to the bottom feed device and movable for horizontal reciprocation, said upper feed arm having an upper feed dog mounted on a free end thereof and positioned to confront the lower feed dog;

(b) spring means for depressing the upper feed arm;

(c) a mechanism for vertically moving said upper feed dog, said mechanism including a crank swingable vertically in response to movement of a drive shaft, the crank having a slider means held in slidable engagement with said upper feed arm for vertically moving said upper feed arm in coaction with said spring means, a swingable shaft having an end, said crank being fixed to said end, a lever angularly movably supported on said swingable shaft and swingable in response to rotation of said drive shaft, and clutch means for disconnectably transmitting swinging movement of said lever to said swingable shaft, said clutch means comprising engagement portions disposed on said swingable shaft and said lever and disengageable from each other in a circumferential direction, said engagement portions on said swingable shaft being normally held against said engagement portions on said lever under the action of said spring means; and (d) retainer means for supporting said slider means against movement away from said upper feed arm.

2. A top feed device for coaction with a bottom feed device having a lower feed dog in a sewing machine, said top feed device comprising:

(a) an upper feed arm supported for vertical swinging movement on a drive member adapted to be operatively coupled to the bottom feed device and movable for horizontal reciprocation, said upper feed arm having an upper feed dog mounted on a free end thereof and positioned to confront the lower feed dog;

(b) spring means for depressing the upper feed arm;

(c) a mechanism for vertically moving said upper feed dog, said mechanism including a vertically swingable crank, slider means activated by said crank and held in slidable engagement with said upper feed arm for vertically moving said upper feed arm, a swingable shaft on which said crank is angularly movably mounted, and clutch means for disconnectably transmitting swinging movement between said crank and said swingable shaft, said clutch means comprising engagement portions disposed on said crank and said swingable shaft and disengageable in a circumferential direction, said engagement portions on said swingable shaft and said crank being normally held against one another under the action of said spring means; and (d) retainer means for supporting said slider means against movement away from said upper feed arm.

3. A top feed device according to claim 2, wherein said engagement portions comprise abutments projecting axially in confronting relation.

4. A top feed device according to claim 2, wherein said engagement portions comprise opposite faces of a straight groove and surfaces of a block fitted in said straight groove for angular movement therein.

5. A top feed device according to claim 2, wherein said retainer means comprises a guide mounted on said upper feed arm, said slider means being held in slidable engagement with said guide.

6. A top feed device according to claim 5, wherein said guide comprises a bifurcated construction.

7. A top feed device according to claim 5, wherein said guide comprises a slot.

8. A top feed device according to claim 5, wherein said guide comprises a rail.

9. A top feed device according to claim 2, wherein said retainer means comprises a leaf spring fixed to the sewing machine for supporting said slider means from below.

10. A top feed device according to claim 2, wherein said retainer means comprises a spring for urging said crank to angularly move upwardly with a force weaker than that of said spring means.

11. A top feed device according to claim 2, wherein said swingable shaft comprises a cutter shaft for driving a cutter for cutting a fabric in the sewing machine.

12. A top feed device according to claim 2, including a second crank fixed to and projecting radially from said swingable shaft, said second crank having said slider means mounted thereon in radially spaced relationship from said swingable shaft, a drive shaft having a driving crank thereon, and means creating a driving connection between said driving crank and said first-mentioned crank.

13. A top feed device according to claim 12, wherein said driving connection includes a slide block which is fixedly but radially adjustably mounted on one of said first-mentioned and driving cranks and is radially slidably supported on the other of said first-mentioned and driving cranks.

14. A top feed device according to claim 2, including a driving shaft extending substantially parallel with said swingable shaft, a driving crank fixed to and projecting radially of said driving shaft, a second crank fixed to and projecting radially of said swingable shaft, a slidable driving connection between said driving crank and said second crank, and said slider means being mounted on said firstmentioned crank in radially spaced relationship from said swingable shaft.

15. A top feed device according to claim 14, wherein said driving connection includes a slide block which is fixedly but radially adjustably mounted on one of said second and driving cranks and is radially slidably supported on the other of said second and driving cranks.

16. A top feed device according to claim 2, wherein said swingable shaft comprises a cutter shaft for driving a cutter for cutting a fabric in the sewing machine, and said slider means being mounted on said crank in radially spaced relationship from said cutter shaft.

17. A top feed device according to claim 2, wherein said slider means comprises a roller disposed in radially spaced relationship from the rotational axis from said swingable shaft.

* * * * *